US005533695A

United States Patent [19]

Heggestad et al.

[11] Patent Number: 5,533,695

[45] Date of Patent: Jul. 9, 1996

[54] INCREMENTAL TRAIN CONTROL SYSTEM

[75] Inventors: Robert E. Heggestad, Raytown; Donald B. Schaefer, Jr., Blue Springs, both of Mo.

[73] Assignee: Harmon Industries, Inc., Blue Springs, Mo.

[21] Appl. No.: 293,064

[22] Filed: Aug. 19, 1994

[51] Int. Cl.[6] ..... B61L 3/20

[52] U.S. Cl. ..... 246/62; 246/122 R; 246/177; 246/182 R; 246/1 R; 364/424.02; 364/426.01

[58] Field of Search ..... 246/14, 15, 62, 246/122 R, 167 R, 177, 178, 182 R, 182 B, 182 C, 167 D, 1 R; 364/424.01, 424.02, 426.01, 426.05

[56] References Cited

U.S. PATENT DOCUMENTS

| | | | |
|---|---|---|---|
| 3,250,914 | 5/1966 | Reich | 246/5 |
| 3,284,627 | 11/1966 | Wilcox | 246/187 B |
| 3,402,289 | 9/1968 | Burke et al. | 246/167 R |
| 3,581,071 | 5/1971 | Payseure | 246/122 R |
| 3,794,833 | 2/1974 | Blazek et al. | 246/63 C |
| 3,967,801 | 7/1976 | Baughman | 246/34 R |
| 4,046,342 | 9/1977 | Buzzard | 246/34 R |
| 4,181,943 | 1/1980 | Mercer, Sr. et al. | 364/426.05 |
| 4,279,395 | 7/1981 | Boggio et al. | 246/182 R |
| 4,495,578 | 1/1985 | Sibley et al. | 364/426.05 |
| 4,655,421 | 4/1987 | Jaeger | 246/167 R |
| 4,711,418 | 12/1987 | Aver, Jr. et al. | 246/5 |
| 4,742,460 | 5/1988 | Hollands | 246/167 R |
| 4,768,740 | 9/1988 | Corrie | 246/25 |
| 5,036,478 | 7/1991 | MacDougall | 246/122 R |
| 5,072,900 | 12/1991 | Malon | 246/5 |
| 5,340,062 | 8/1994 | Heggestad | 246/167 R |

OTHER PUBLICATIONS

Advanced Train Control Systems, System Architecture, ATCS Specification 100, Revision 3.0 (Mar. 1993).

*Primary Examiner*—Robert J. Oberleitner
*Assistant Examiner*—S. Joseph Morano
*Attorney, Agent, or Firm*—Chase & Yakimo

[57] ABSTRACT

A train control system employs a series of wayside control units spaced along the track, each of which has responsibility for the control of trains in a corresponding local area and monitors track availability and signal status in its local area. Each wayside unit has a data base in memory that comprises fixed data defining an operational profile of the associated local area, and is provided with a data radio for transmitting profile messages containing the fixed data for that area and authority messages containing the dynamic data bearing track availability and signal status information. A data radio in a receive mode on a train receives the data transmissions from the wayside unit or units responsible for its control, and an on-board computer determines the proper train control instructions from the received data. A central control facility may also be provided for storage of master fixed data files that cover the entire route, relevant portions thereof being downloaded to respective wayside units via dispatcher data lines and updated periodically as necessary.

23 Claims, 16 Drawing Sheets

INCREMENTAL TRAIN CONTROL SYSTEM

BACKGROUND OF THE INVENTION

This invention relates to improvements in systems for controlling the movement of a train along a railroad track and, more particularly, to a train control system which integrates dynamic and fixed data concerning the route over which the train is traveling and conditions existing on the track ahead, and which provides positive train control based on signal status and an operational profile of the route.

Railroad signalling and train control systems have traditionally been based on the concept of protecting zones of track, called "blocks," by means of some form of signal system that conveys information to the locomotive engineer about the status of one or more blocks in advance of the train. Wayside signal lights located along the track are controlled by electrical logic circuits which use track circuits to detect the presence of a train in any given block, and automatically combine the status of several adjacent blocks to present the proper aspect, or combination of lights, to indicate to the train crew whether the train may proceed at maximum speed, should reduce speed due to more restrictive conditions ahead, or should be brought to a stop. The distance required to slow or stop a moving train is sufficiently long that information must be conveyed to the train at least one full block in advance of where the reduced speed or stop is required.

An alternative approach which is used on portions of some railroad systems is referred to as cab signalling and may be used with or without wayside signal lights. In cab signalling the same logic that determines block status for display on the wayside signals is also used to generate one of several forms of encoded electrical current in the rails, such that block status is represented by the selection of the code rate used. Equipment on the locomotive detects the coded currents through inductive pickup coils located just above the rail and ahead of the lead wheels, and decodes the information to arrive at a status to be displayed in the engine cab in the form of a pattern of lights similar to those used on wayside signals. The particular pattern of lights displayed is called the "aspect" of the signal. Displaying this information in this manner makes the block status visible to the train crew continuously, not just while approaching a wayside signal, and also permits any change in block status to be displayed immediately as it happens rather than at the next wayside signal which may be far ahead and out of sight at the time of the change in status.

Most cab signal systems include some form of automatic train control (ATC) feature which uses one or more methods to assure that the train crew is alert and responding to any changes in cab signal aspects. Some of these systems only require acknowledgement of the change, while others require application of brakes within a minimum time interval as assurance that a more restrictive condition is recognized by the crew.

Cab signal systems, however, employ a code transmitter coupled to the track for the purpose of transmitting the coded currents along the track a desired distance. A problem of sufficient range can occur in long blocks and the presence of the coded current creates a source of possible interference with other track circuits. Therefore, train control systems have been proposed that entirely eliminate wayside signals and the transmission of dynamic data via coded current in the rails, two of which will be discussed briefly below.

U.S. Pat. No. 4,711,418 to John H. Auer, Jr. et al issued Dec. 8, 1987 and is directed to a radio based control system in which the transmission of dynamic data (speed aspect, etc.) is accomplished entirely by radio transmissions from a central control office to the trains traveling along the track. The central office computer is the source of the dynamic data which indicates block status as determined not by track circuits but by location reports transmitted to the central control office from the trains via radio. Fixed data as to distances and location is provided by trackside transponders.

A current ATCS (Advanced Train Control System) industry specification also describes a system which does not involve the wayside signals and, like Auer, determines block status at the central office based on location reports received from the trains and transmits the resulting dynamic data back to the trains in the form of movement authorities. In this proposed system, trackside transponders are used as location reference markers from which actual location is measured by odometer. Additional fixed data, e.g., distance data and civil speed limit data, is stored in master files and maintained at the central office. For an operating train, the portion relevant to the train's route is transferred to on-board memory. Both Auer and the ATCS systems, however, require duplicating, in a central office computer, most or all of the vital logic performed at interlockings and on the rail line between interlockings. This creates the potential for a discrepancy in timing, if not in content, between authorities granted from the central office logic versus those displayed by the wayside signals, some of which must always be maintained as a backup to protect trains in the event of failure of the more sophisticated control system.

SUMMARY OF THE INVENTION

It is, therefore, a general object of the present invention to provide a train control system which uses the existing wayside signal system as a base, takes the dynamic data output of this existing system and transmits it to a train by radio for on-board enforcement.

More particularly, it is an important object of this invention to provide such a train control system in which fixed data defining an operational profile of a segment of the route is also transmitted to the train and all restrictions therein enforced.

Another important object is to provide a train control system as aforesaid which employs wayside control units spaced along a route to be traveled by a train, each of which has responsibility for the control of a train in a corresponding local area or segment of the route and monitors track availability and signal status information in its local area, dynamic data bearing that information being transmitted by radio to the train from each wayside unit as the local areas are successively addressed by the moving train.

Another important object is to maintain a data base at each of the wayside control units comprising fixed data defining an operational profile of a corresponding local area, such fixed data also being transmitted by radio to the train from each wayside unit as the local areas are successively addressed by the moving train.

Still another important object is to provide a train control system as aforesaid which may also employ a central control facility at which fixed data defining the operational profile of a route is stored, whereby the data base at each wayside control unit may be modified by transmission thereto of changes in the operational profile from the central control facility.

Yet another important object is to provide such a train control system in which an authority message containing the dynamic data is transmitted from an associated wayside unit and is valid for a predetermined time period, an appropriate default rule being applied if no repeat transmission of the authority message is received by the train in response to subsequent interrogation.

Other important objects of the present invention include providing a train control system which is compatible with existing track circuits without modification; providing such a system which is capable of updating fixed data as to route profile with changes pursuant to temporary slow orders; providing a control system which enforces full stops at interlockings, enforces timetable speed limits and civil speed restrictions, and enforces temporary slow orders which the system treats as a civil speed restriction until removed by the dispatcher; providing a control system which minimizes the data network through communications with the train that are generally short ranges of less than five miles, by transmitting to the train from wayside control units rather than from a central control office; the ability to install the automatic control system incrementally as needed; the ability to provide communication with the train via a series of wayside control units spaced along the route, each of which monitors track availability and signal status to derive dynamic information and has a data base in memory that comprises the fixed data defining an operational profile of the associated local area; and the ability to provide a control system that measures train length automatically so that speed restrictions applying to the entire train length can be properly obeyed.

In furtherance of the foregoing objects, the train control system of the present invention transmits two primary message types (profile and authority) to the on-board computer of a train under control. The profile message is fixed data in the nature of a "map" of a segment of the route and includes timetable speed limits, civil speed restrictions and the locations of all points at which a control action may be required. The authority message is dynamic data derived from the wayside vital logic, i.e., track circuits and signal circuits. The train's on-board computer merges train location information (from trackside reference transponders, odometer tracking or other sources) with the fixed and dynamic data to determine the proper train control instructions.

The system may employ a central control facility in which master fixed data files are stored that cover the entire route under control. A dispatcher data line downloads relevant portions of the fixed data files to respective wayside control units spaced along the route, each of which is responsible for control of trains in an associated local area of the route. The data transmission from the central facility to the wayside control units may be accomplished by radio, wire lines, a cellular telephone link, or other suitable means as appropriate for each wayside unit.

The wayside control units are spaced along the route at appropriate intervals, such as ten miles, and are located at interlockings and special detection sites. Each wayside unit transmits both fixed and dynamic data to trains entering the local area under its control. Local fixed data files at each wayside unit define the operational profile of the associated local area, e.g., timetable speed limits, civil speed restrictions, temporary slow orders which are treated as a civil speed restriction until removed by the dispatcher, and critical locations. This information may be downloaded from the central control facility and updated periodically as necessary via the dispatcher data line, or the fixed data files for each local area may be maintained independently in systems in which central control is not employed.

The wayside control unit derives the dynamic data for its local area utilizing, where available, existing track and signal circuits. The local fixed data comprising the profile message and the local dynamic data comprising the authority message are transmitted to a data radio on board the approaching train. The data radio, in a receive mode, decodes the incoming profile and authority messages and delivers that information to an on-board speed monitoring and enforcement computer where the fixed and dynamic data are integrated with location information that identifies the exact position of the train along the route. An operator display instructs the train crew in accordance with the total information received. The computer enforces speed restrictions, slow orders and required stops if instructions are not recognized by the crew and obeyed.

In a transmit mode, the on-board data radio sends message requests to the wayside control unit responsible for operations in the local area occupied by the train. Authority messages (containing dynamic data) are valid for only a predetermined time period such as fifteen seconds and must be periodically refreshed or the on-board computer executes a default rule for the particular local area. Accordingly, the wayside unit is interrogated within the expiration period to cause a repeat transmission of the authority message, a failure of the train to receive a fresh authority message after a selected number of successive interrogations causing the default rule to be applied.

THE CONTROL SYSTEM IN GENERAL

Figure 1:
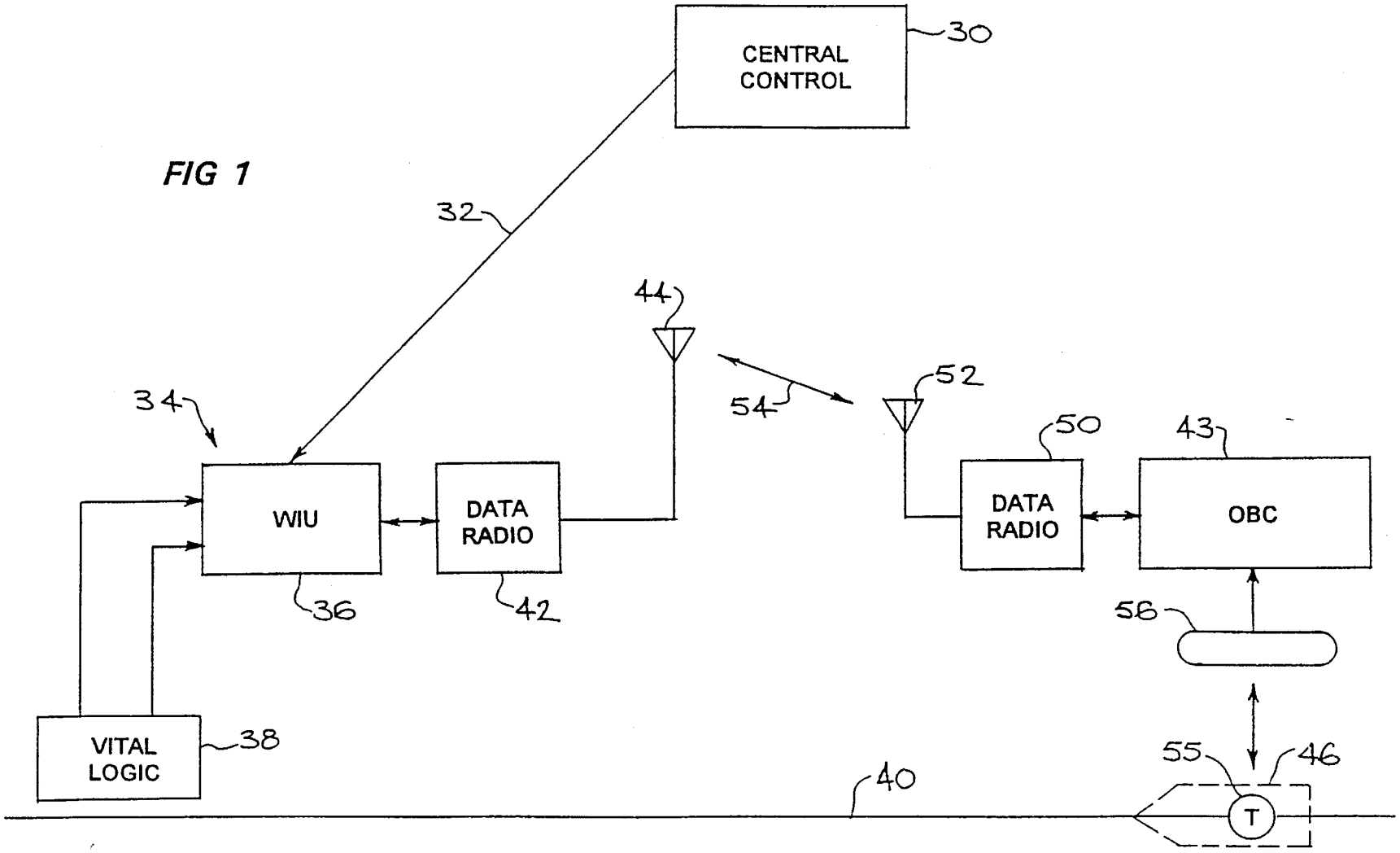
FIG. 1 is an overall block diagram of the train control system of the present invention.

Referring initially to FIG. 1, a central control office facility 30 has master fixed data files stored in a central computer memory and which contain all data relating to the profile of a route under control. This fixed data comprises, in effect, a library of information that will in normal circumstances remain unchanged for the route. In addition to timetable speed limits and civil speed restrictions, the fixed data files may include such information as the location of track under repair and an appropriate temporary slow order, the location of critical locations and any other points at which a control action may be required. A dispatcher data line 32 connects the central control 30 with a wayside control unit generally designated 34 which includes, as elements thereof, a wayside interface unit (WIU) 36, vital logic 38 associated with a particular location on a rail line 40, and a data radio 42 having an antenna 44. As will be subsequently discussed, a series of wayside control units 34 are spaced along the track under control at interlockings and special detection sites and are in communication with central control 30 via their respective dispatcher data lines 32. Accordingly, relevant portions of the master fixed data files are downloaded from central control 30 to the wayside control units 34 via respective data lines 32 so that each wayside control unit has the profile of the particular local area of the route under its control.

It should be understood that the central control 30 is not an absolute requirement of the system of the present invention. The central control 30 via the dispatcher data lines 32 provides a means of instantly updating the route profile as may be necessary from time to time. However, the local fixed data files of the individual wayside control units 34 may be individually maintained and updated as changes in fixed data occur in affected local areas.

The vital logic 38 typically comprises existing track circuits and signal circuits associated with a wayside signal. Therefore, the WIU 36 utilizes this signal and track status information to provide the dynamic data that comprises an authority message transmitted by data radio 42.

FIG. 1 also illustrates a train 46 by the symbol in broken lines showing train movement from right to left in the illustration. In the locomotive a speed monitoring and enforcement computer (OBC) 48 receives profile and authority messages from the wayside control unit 34 via a data radio 50 having an antenna 52. An arrow 54 illustrates the radio link between the data radio 42 of the wayside control unit 34 and the on-board data radio 50.

The train 46 is shown in FIG. 1 at a trackside transponder 55 on the rail line 40. The transponder 55 is a passive beacon transponder that is interrogated by a passing train as illustrated by the interrogator antenna 56 which is typically mounted adjacent the underside of the locomotive. Transponder 55 is of the general type disclosed in the aforesaid U.S. Pat. No. 4,711,418 and, when interrogated, responds with a serial data message bearing a location reference such as a milepost number. As will be discussed in detail below, the on-board computer 48 merges this train location information with the fixed and dynamic data received via radio link 54 to determine the proper train control instructions. (It should be understood that the use of beacon transponders for location reference purposes is by way of example only, as other means of providing the precise location of the train may be employed.)

Figure 2:
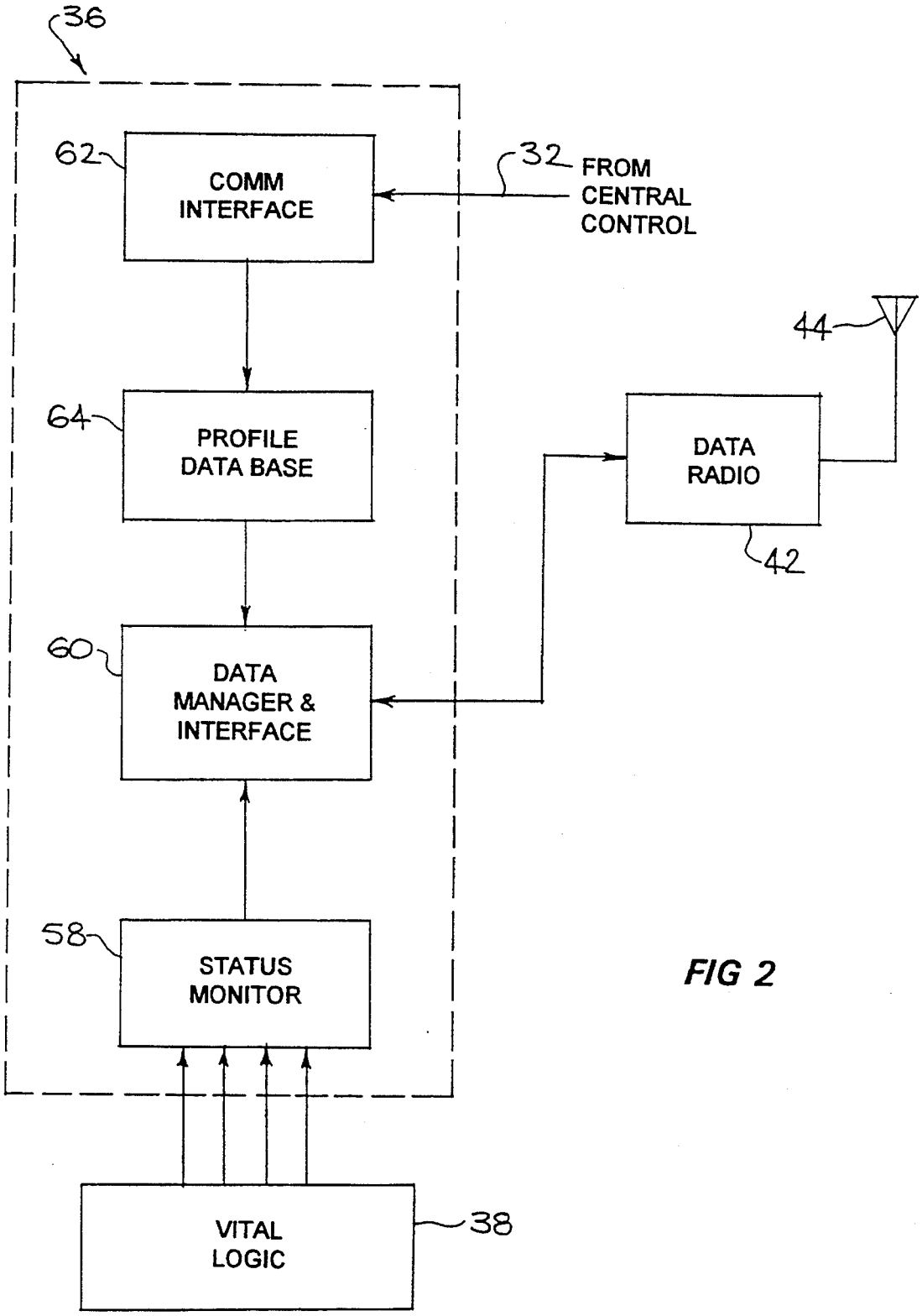
FIG. 2 is a block diagram of a wayside control unit.

FIG. 2 shows the wayside control unit 34 in greater detail. The WIU 36 includes a status monitor 58 that receives the information from the track circuits (presence or absence of a train) and signal circuits (aspects) of the vital logic 38 and delivers this information to a data manager and interface 60. A communications interface 62 receives the fixed data updates when they appear on the dispatcher data line 32 and delivers the updates to a memory 64 containing the local profile data base. The data manager 60 employs a microprocessor to handle fixed data from memory 64 and dynamic data from monitor 58 to form the profile and authority messages delivered to data radio 42 for transmission via antenna 44.

Figure 3:
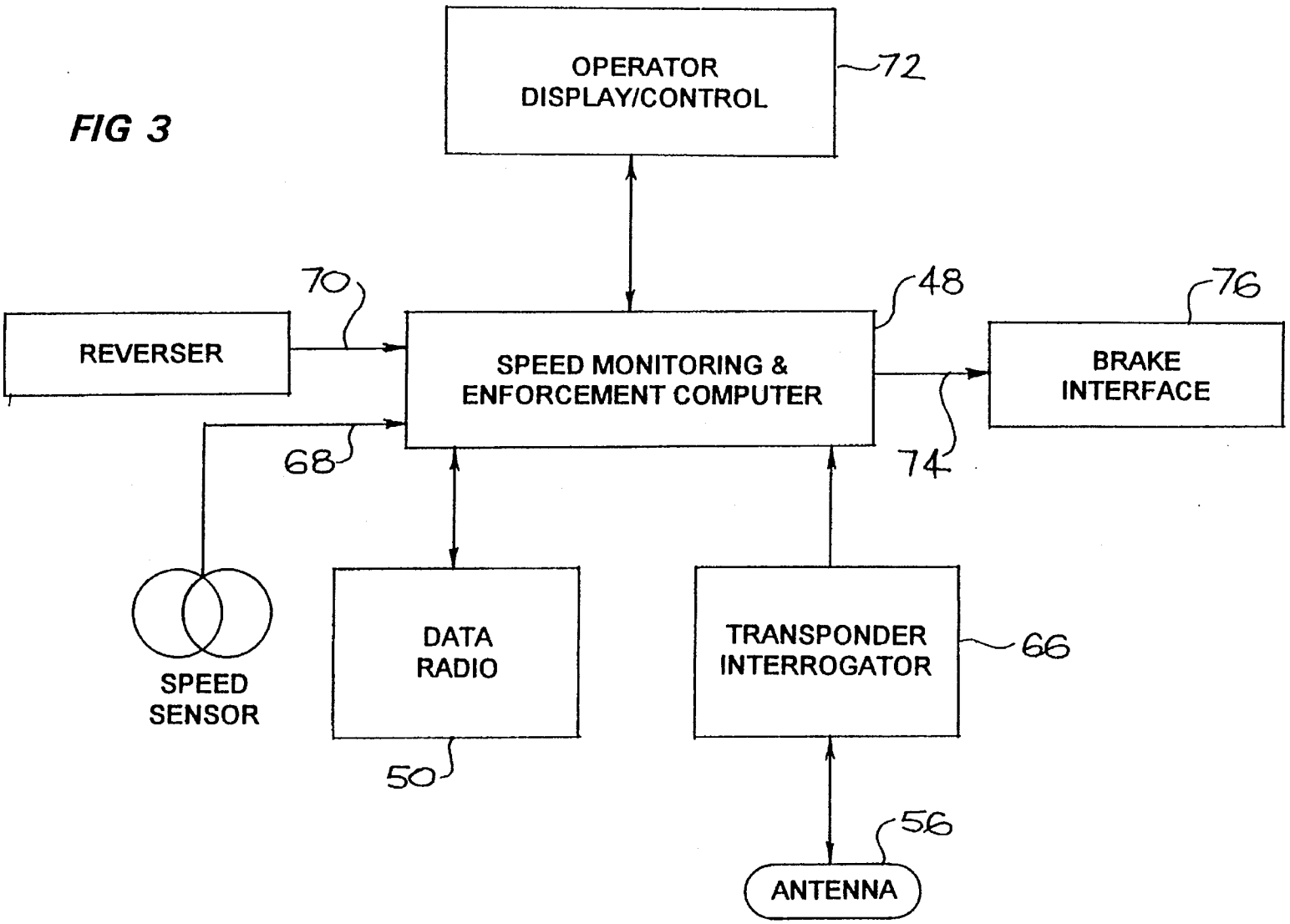
FIG. 3 is a block diagram showing the components of the system on board a train.

FIG. 3 shows the function and interrelationship of the components of the system located on board a train, such as the train 46 in the example of FIG. 1. The data radio 50 is normally in a receive mode and decodes incoming profile and authority messages and delivers that data to the speed monitoring and enforcement computer (OBC) 48. The hardware components of OBC 48 include a central processing unit (CPU), a read-only memory for program storage, a random access memory for storage of transient data derived from the input dynamic and fixed data, interfaces to the inputs and outputs of OBC 48 shown in FIG. 3 and internal self-testing hardware and software.

A transponder interrogator 66 connected to antenna 56 accomplishes the interrogation of trackside transponders such as transponder 55 (FIG. 1), the location data read by the interrogator 66 being fed to the OBC 48 where it is integrated with fixed and dynamic data from the data radio 50 so that the OBC may determine the proper train control instructions. Other inputs to OBC 48 that bear upon the nature of the train control instructions comprise an input 68 from a speed sensor such as axle tachometers on the locomotive and an input 70 which monitors the position of the reverser lever in the control cab so that the computer is made aware of the direction of movement of the train. Information from the speed sensor is, of course, readily converted into distance traveled and speed of motion of the train for use by the speed enforcement logic. An operator display and control unit 72 located in the cab (see FIGS. 12–20) shows the train crew the "current speed" that the train is traveling, the "speed limit" currently in effect, the "current milepost," "track name," the direction of movement ("Dir"), "target speed" in response to an upcoming speed restriction, "distance to target" in feet, and a "time to penalty" designated in seconds which informs the engineer of the time remaining before a penalty brake will be applied if the train continues at its present speed. The penalty brake command is delivered by removing a vital output 74 of the OBC 48 to a brake interface 76.

WAYSIDE CONTROL UNIT OPERATION

Figure 4:
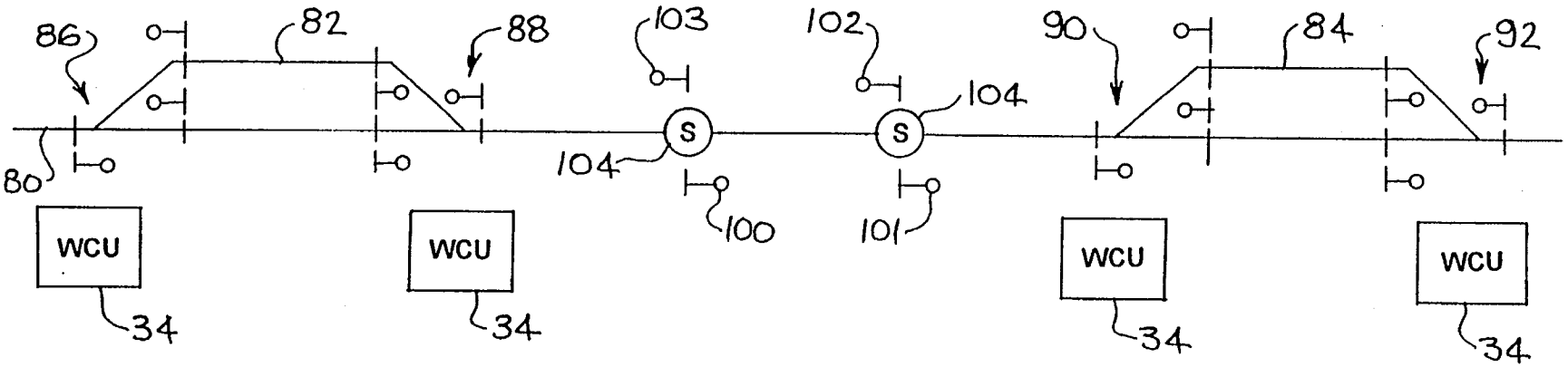
FIG. 4 is a single track layout showing an example of the placement of wayside control units along the track.

FIG. 4 is an example of a portion of a rail line comprising a single track 80 having two passing sidings 82 and 84. Accordingly, interlockings 86 and 88 are presented at the ends of siding 82 which join the main track 80 at switches (not shown) under the control of a train management system independent from the control system of the present invention. Similarly, interlockings 90 and 92 are presented at the ends of passing siding 84. Typically, each of the sidings is approximately two miles in length and the spacing therebetween is approximately ten miles, thus FIG. 4 is for illustrative purposes and is not to scale.

Four wayside control units 34 are shown along track 80 and are located at respective interlockings 86, 88, 90 and 92. Each unit (WCU) 34 is responsible for the control of trains approaching it within a local area covered by the WCU, such local area being defined by the stretch of track extending to the next adjacent interlocking in either direction, or to a point beyond the longest braking curve, whichever is longer. For example, the local area for the WCU 34 at interlocking 88 in FIG. 4, for trains moving from right to left, begins at the left end of interlocking 90 and extends to the left end of interlocking 88. The local area for interlocking 86, also for trains moving right to left, begins at some point between interlockings 88 and 90 which is sufficiently far from interlocking 86 that an authority from WCU 34 at interlocking 86 can be delivered to an approaching train at least one minute before braking would be initiated to reach a stop at interlocking 86 when traveling at the maximum speed. At any one time, a train may be within the local area of more than one interlocking, and receiving authorities from each of them. Trains moving from left to right between interlockings 88 and 90 will be in the local area of interlocking 90, and at some point prior to reaching interlocking 90 will also move into the local area of interlocking 92.

Figure 5:
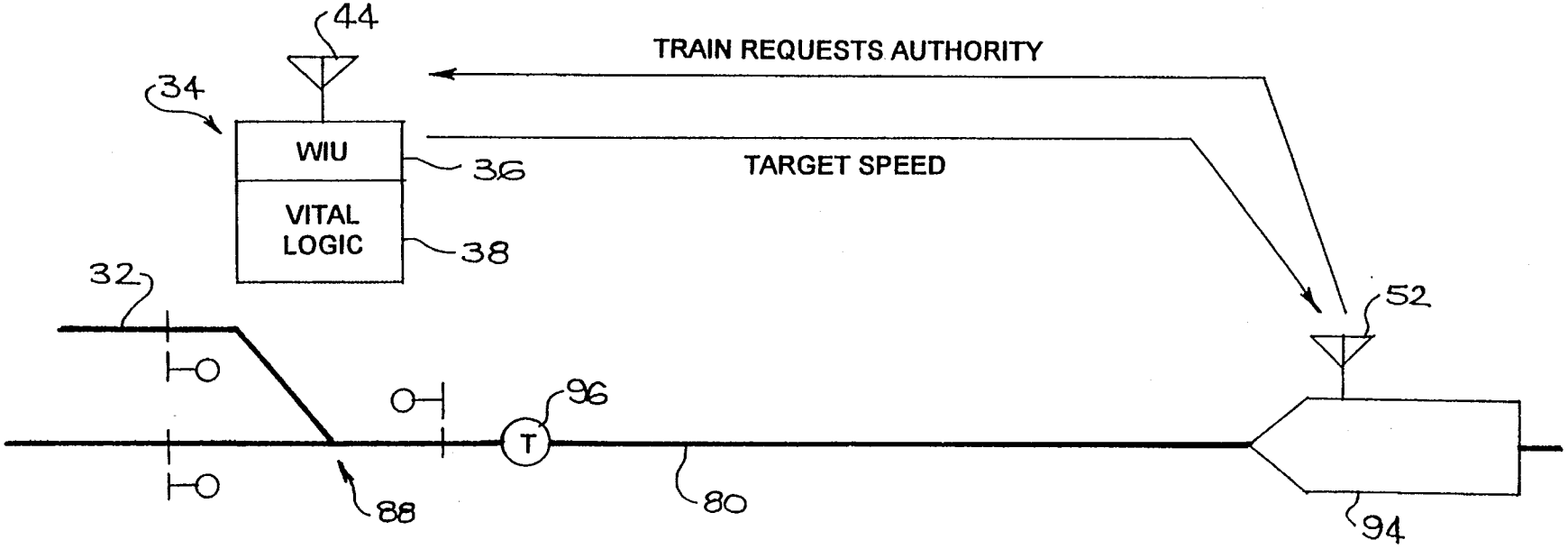
FIGS. 5–8 are progressive views illustrating a train as it approaches and clears an interlocking, and shows initial and update authority requests, an arrival report, and a train clear report.

FIG. 5 shows in detail the portion of the track in FIG. 4 leading toward interlocking 88 as it is approached by a train 94 traveling from right to left. The on-board computer (OBC) 48 commands the data radio 50 (FIG. 3) to go to its transmit mode and request an authority from the wayside control unit 34 due to the approaching interlocking 88, it being remembered that the OBC 48 on train 94 is continuously provided with the exact location of train 94 along track 80. The OBC 48 has in memory the profile of the local area which it previously received from the wayside control unit 34 upon entry into the area under its control. That profile established a prompt location on track 80 at which an authority is to be requested as illustrated in FIG. 5. In the example, the wayside control unit 34 responds with an initial authority comprising a new target speed effective at interlocking 88.

Figure 6:
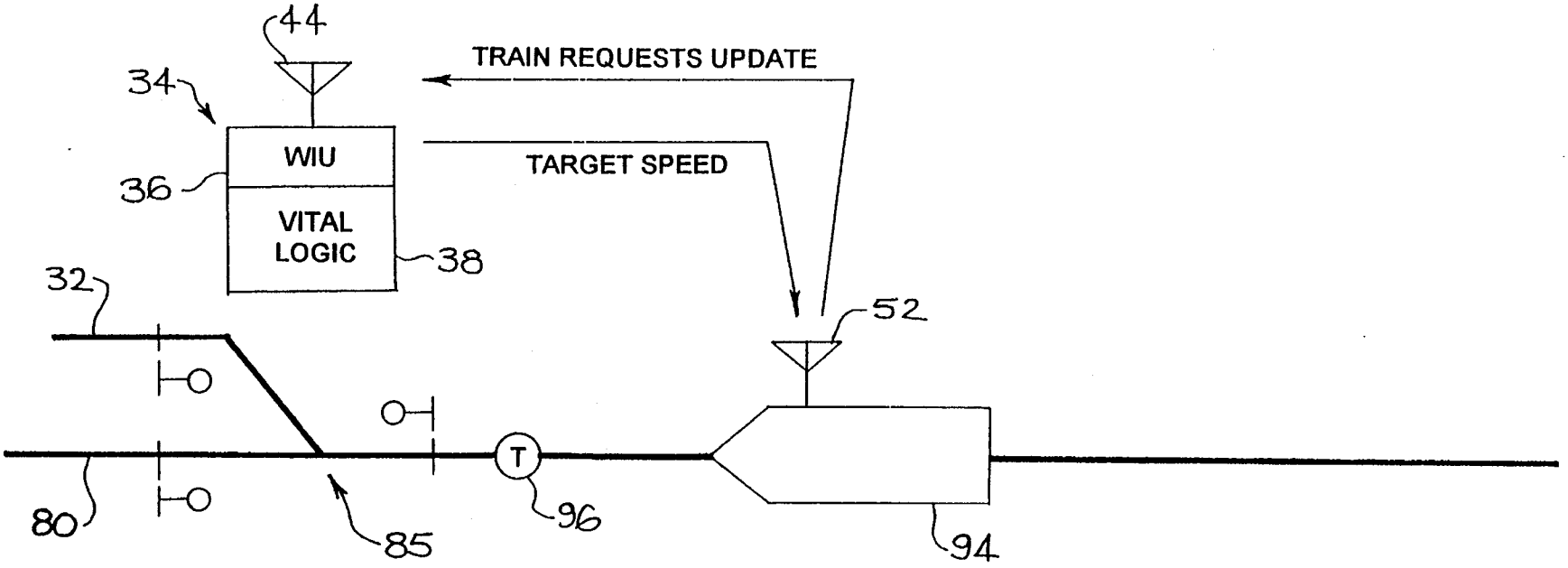

FIG. 6 shows train 94 at a later time but still approaching interlocking 88 and illustrates a request for an authority update. As authority messages comprise dynamic data that is subject to change, an authority message is valid for only a predetermined time period such as fifteen seconds. If not periodically refreshed, the OBC 48 executes a default rule for the particular local area as contained in the profile message in memory. If a repeat transmission of the authority message is not received after two successive update requests, the default rule is applied. In the example of FIG. 6, the train 94 has requested an update and the wayside control unit 34 responds with a fresh target speed authority which may be the same as the initial authority or a different speed depending upon conditions within the local area. In addition to the authority update being transmitted on request, any change in status at the interlocking which causes a change in instructions to the approaching train will initiate an immediate update transmission to the train without waiting for the next update request.

Figure 7:
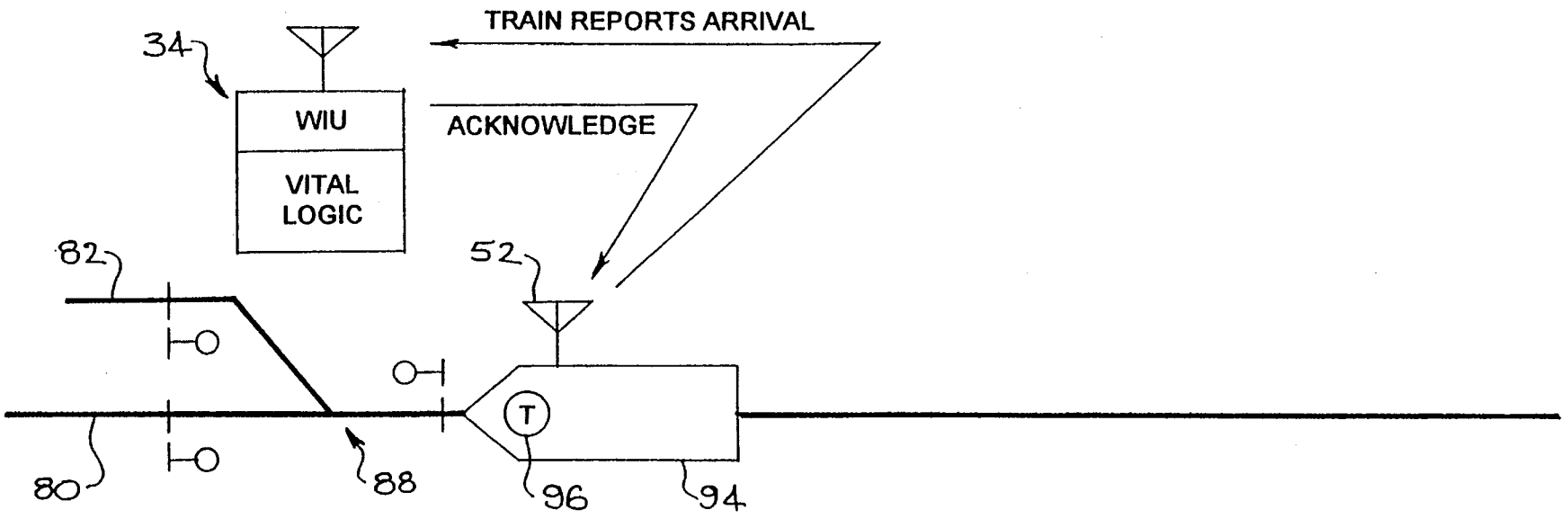

FIG. 7 illustrates authority completion. The train 94 has arrived at the interlocking 88, reports its arrival, and the same is acknowledged by the wayside control unit 34.

Figure 8:
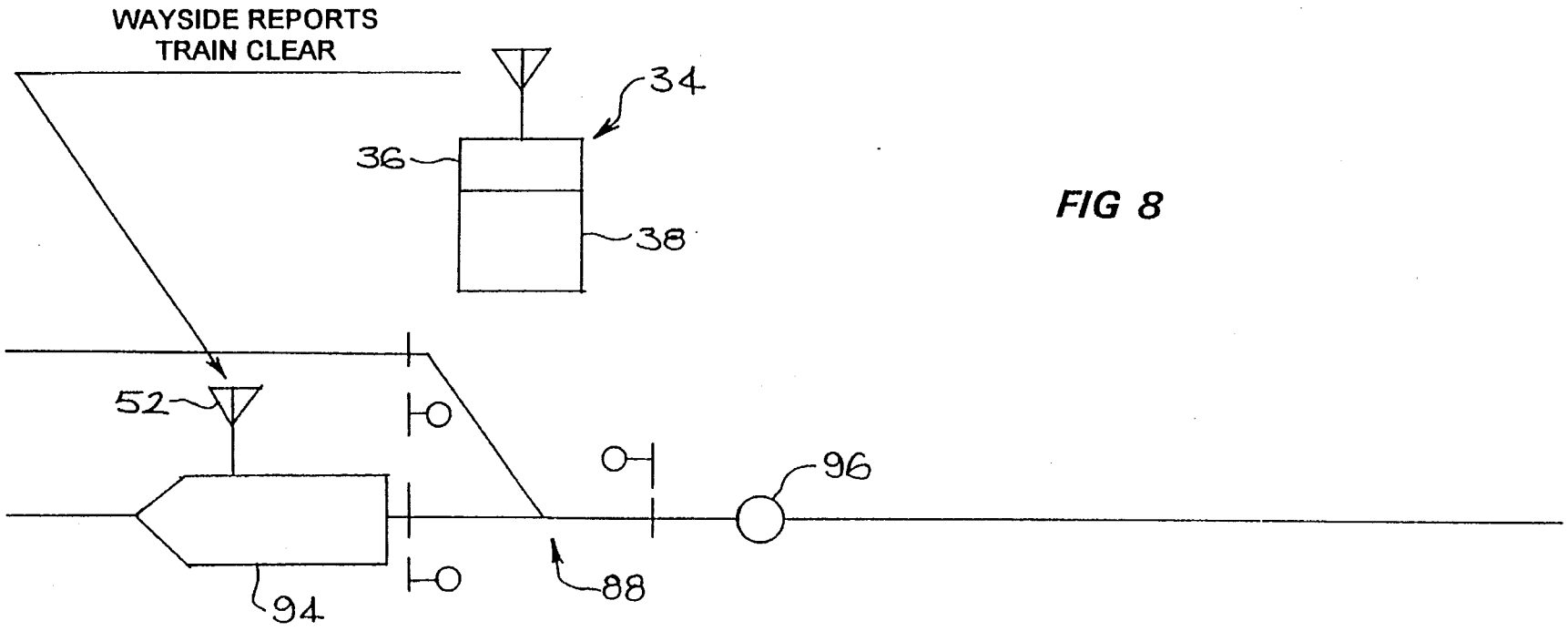

FIG. 8 illustrates further progress of train 94 and shows that it has passed the interlocking 88, resulting in a "clear of interlocking" report from the wayside control unit 34. The OBC 48 may now compute train length as it is the distance between the interlocking location and the location of the locomotive at the time the "clear" message is received. At this point the train 94 is leaving the local area under the control of wayside unit 34 seen in FIGS. 5–8. Assuming the typical 2-mile siding, the train would have already entered the local area of wayside unit 34 at interlocking 86 (FIG. 4).

It should also be noted that a trackside transponder 96 is shown in FIGS. 5–8 in the immediate approach of train 94 to interlocking 88. As the train 94 approaches a critical location such as the interlocking 88, it is important that the train location information received by the OBC 48 be absolutely accurate. Therefore, in systems in which train location is provided periodically by trackside transponders such as the transponder 55 shown in FIG. 1, a location reference update to correct any odometer error would be provided by transponders at approaches to critical locations as illustrated by the transponder 96.

INTERMEDIATE SIGNAL LOCATIONS

Referring to FIG. 4, intermediate wayside signals 100, 101, 102 and 103 are shown between the two sidings 82 and 84. Signals 100 and 101 are for traffic moving from left to right and signals 102 and 103 are for traffic moving from right to left. At such intermediate signal locations, data could be sent to trains using radio messages in the same manner as discussed above at interlockings. However, this may not be cost justified in a given situation as the amount of data needed at the intermediate signal may be minimal. Accordingly, rather than installing a wayside control unit at each of the intermediate signals in FIG. 4, an alternative would be to employ a switchable transponder at each signal location under the control of the wayside signal circuits. Two such switchable transponders are diagrammatically illustrated at 104 in FIG. 4 and would be enabled only when the aspect displayed in either direction at that signal does not require a speed reduction approaching the next signal.

The location of all such signals provided with switchable transponders would be a part of the fixed data that digitally describes the profile of the route. Accordingly, failure to read the transponder would result in a speed reduction to restricting before reaching the next signal.

ACCEPTANCE OF DATA

Figure 9:
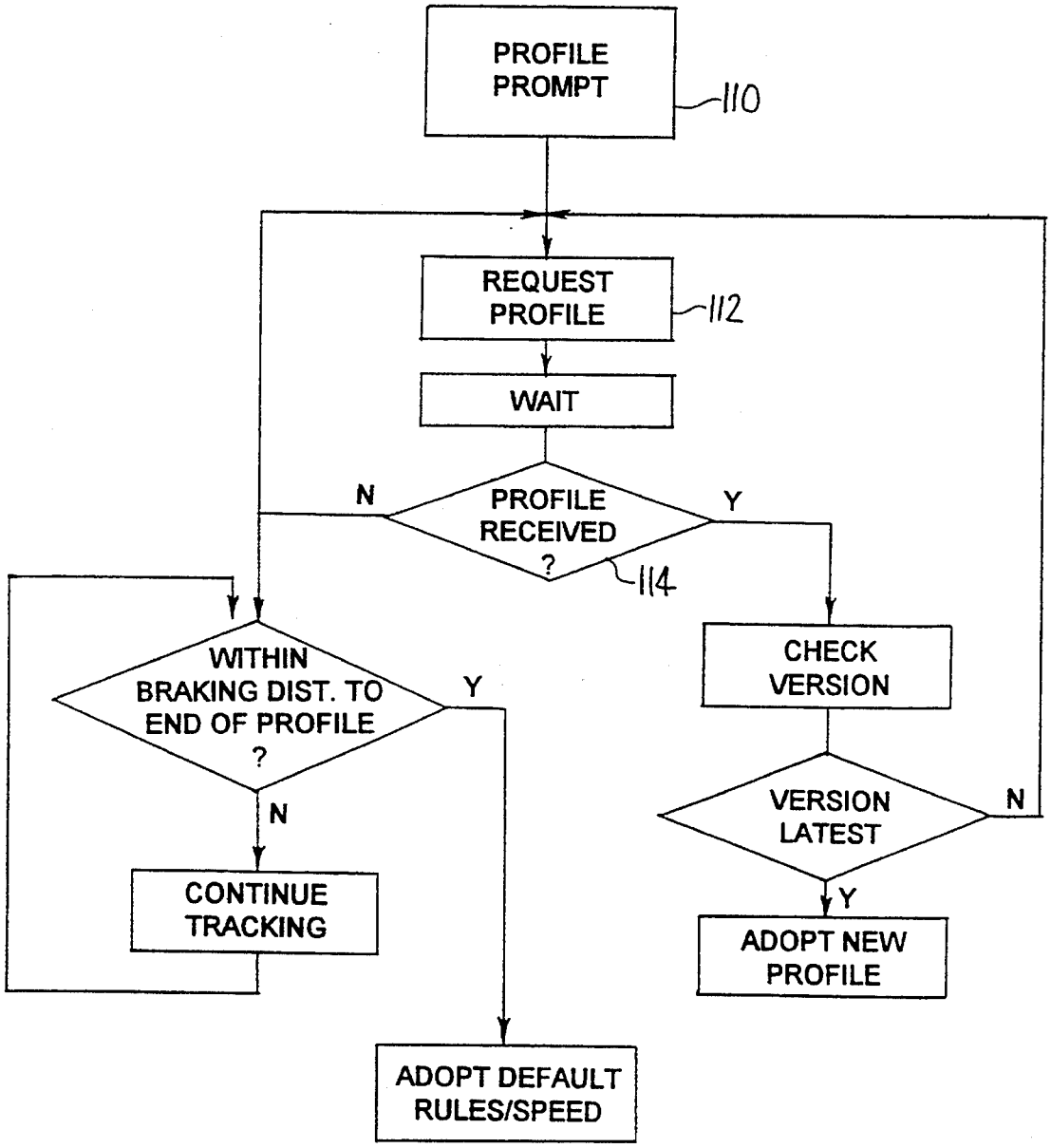
FIG. 9 is a flow chart of a request and receive routine used by the on-board computer to accept fixed data transmitted by the wayside control units.
Figure 10:
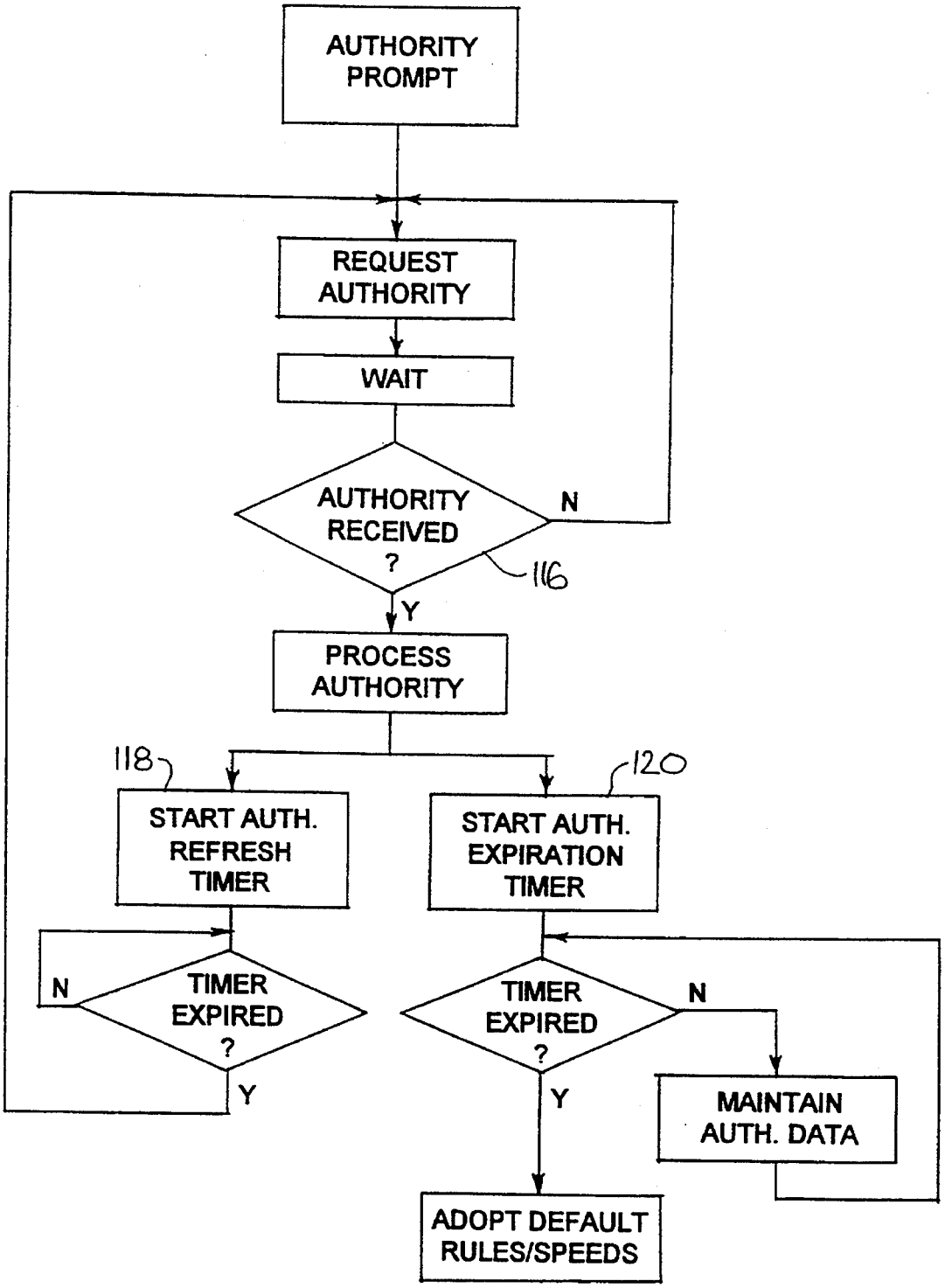
FIG. 10 is a flow chart of a request and receive routine used by the on-board computer to accept the dynamic data transmitted by the wayside control units.

FIGS. 9 and 10 are flow charts of request and receive routines which enable the OBC 48 to accept fixed and dynamic data, respectively, transmitted by the wayside control units. Referring first to fixed data (FIG. 9), it will be appreciated that it is necessary for the train to request and receive a new profile message when it leaves one local area and enters another. Accordingly, the initial step in the software routine of FIG. 9 is profile prompt 110 initiated by the previous profile data as the train approaches an area boundary. A new profile is requested (112) and if received (decision block 114) the new profile is adopted if it is the latest version. If the profile is not received, the request is repeated. A default rule or speed restriction is adopted if the train moves within braking distance to the end of the profile before a new profile is received. Ultimately, the train cannot proceed without a new profile. The requests are, of course, transmitted via the data radio 50 and antenna 52.

Referring to FIG. 10, it will be appreciated that authority requests are repeated frequently due to the nature of dynamic data. Therefore, a received authority (decision block 116) starts two timers as indicated by start authority refresh timer 118 and start authority expiration timer 120. Typically, the refresh timer has a ten second period and the expiration timer has a thirty second period. At the expiration of the refresh timer period, the authority request is repeated. However, if the expiration timer expires (meaning that two successive authority requests have gone unanswered) then the appropriate default rule or speed restriction is adopted.

OBC CONTROL OPERATION

Figure 11:
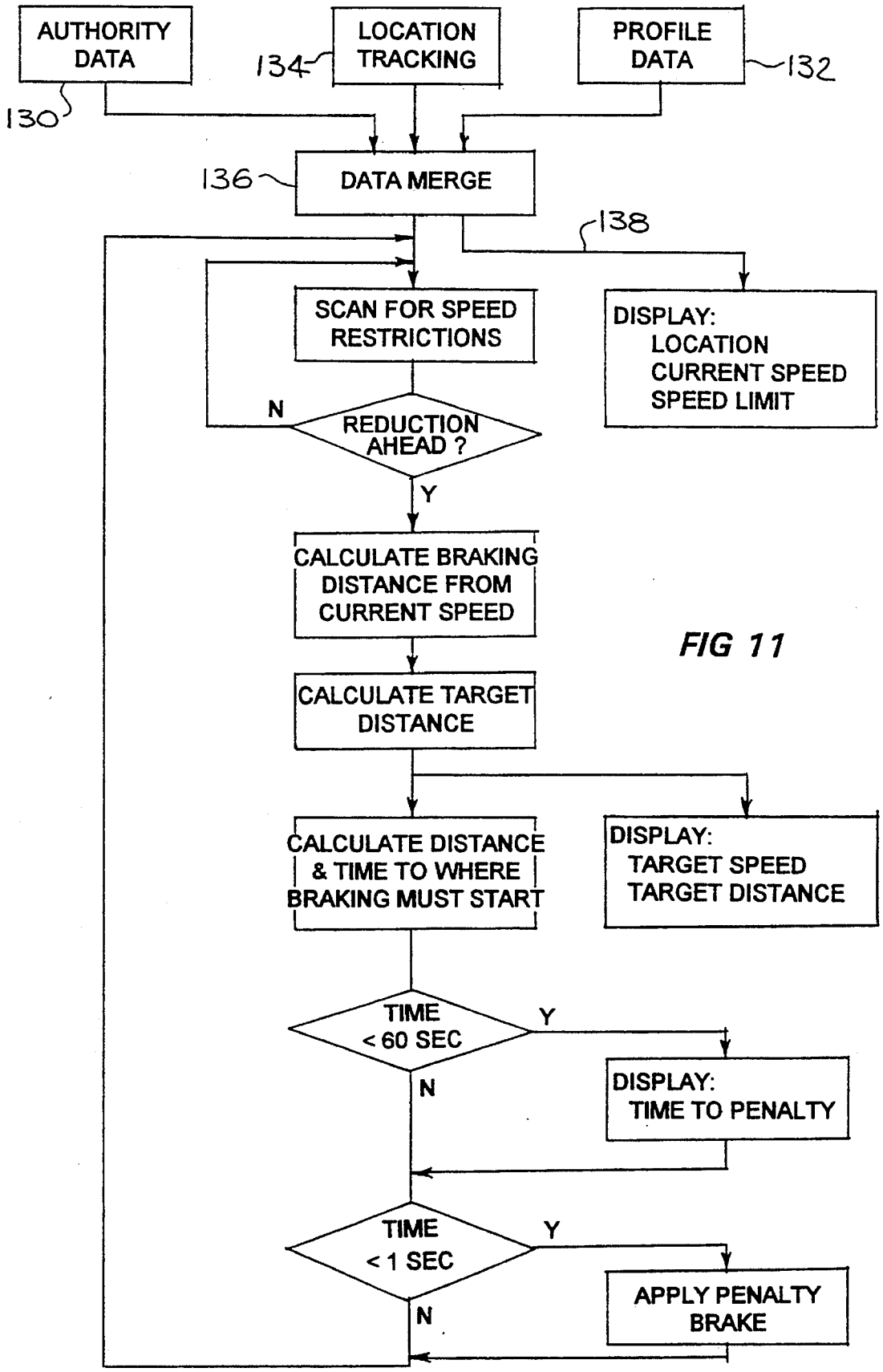
FIG. 11 is a block diagram and flow chart illustrating a control operation by the on-board computer.

The block diagram and flow chart of FIG. 11 illustrates that authority data (dynamic data) 130, profile data (fixed data) 132 and train location 134 are integrated in the OBC 48 as represented by the "data merge" function 136. The computer scans for speed restrictions and, if a reduction is ahead, calculates braking distance based on current speed, target speed, track gradient and train braking ability. The "target speed" and calculated "distance to target" are displayed to the train crew on the operator display 72 (FIG. 3, and see FIGS. 12–20). Then, the distance and time to where braking must start is calculated. If the remaining time is less than sixty seconds, "time to penalty" is displayed. If the time remaining is less than one second, the penalty brake is applied. If the remaining time is greater than sixty seconds, no action is taken. The OBC 48 also sends routine data to the operator display 72 via data line 138 in FIG. 11 to cause the display to show the "current speed," "speed limit," "current milepost" and other information as shown in FIGS. 12–20.

It will be appreciated that the use of braking curves to establish a braking profile and the enforcement of speed restrictions and stops through automatic braking (penalty brake) are well known in automatic train control systems as disclosed, for example, in the copending application of Robert E. Heggestad, Ser. No. 07/929,790, filed Aug. 13, 1992 now U.S. Pat. No. 5,340,062. Therefore, these functions of the OBC 48 will not be discussed in detail herein.

SUMMARY OF MESSAGE FLOWS

The following summarizes the types of messages that are transmitted by the train, each wayside control unit, each location transponder and the central control facility. In systems in which a central control is not employed, the profile data files in the memory 64 of each WIU 36 are independently maintained directly by operating personnel or via a local data line.

Train OBC to wayside WIU

1. Request route profile.
2. Request route authority.
3. Arrival at interlocking.

Wayside WIU To Train OBC

1. Route profile.
2. Route authority.
3. Clear of interlocking.

Location Transponder to Train

1. Enter/Exit controlled territory, WIU address, radio channel.
2. Location identification (milepost).

Central Control to WIU

1. Update profile.
2. End point locations and speed of temporary restriction.
3. Remove restriction.

WIU to Central Control

1. Confirm profile update.
2. Add or remove restriction.

SUMMARY OF TYPICAL OPERATION

The following summarizes the control actions that occur in the system in response to a regularly occurring event, such as a train approaching an interlocking as described above with reference to FIGS. 5 and 6, train approaching a speed restriction, etc.

Train Enters Controlled Territory

1. Passes entry transponder that identifies territory boundary, establishes timetable direction and gives information on where to call for route profile.
2. Train OBC sends message, requests profile.
3. WIU receives message, sends profile to train OBC (includes area from train to second interlocking).
4. Position tracking begins (such as odometer measurement from last transponder).

Train Approaches Interlocking

1. Profile prompts OBC to request authority.
2. Train OBC requests authority.
3. WIU sends authority (target speed at home signal).
4. Operator display shows target information:
   Target speed if less than current limit
   Distance to target
   Time to penalty if relevant
5. Train OBC re-requests authority at periodic intervals (authority expires if not refreshed).
6. WIU sends authority update immediately if it changes.

Train (Locomotive) Enters Interlocking

1. Train OBC sends arrival message to WIU.

Rear of Train Clears Interlocking

1. WIU sends "Clear of Interlocking" message to train OBC.
2. Train OBC calculates train length by comparing locomotive location with interlocking location at the time the "clear" message is received.
3. Diverging speed restriction released.

Train Approaches Speed Restriction

1. Operator display shows target information:
   Target speed if less than current limit
   Distance to target
   Time to penalty if relevant Train Leaves Speed Restriction 1. Resume speed allowed only after entire train passes.

DISPLAYS OF OPERATING SITUATIONS

The illustrations of the operator display 72 in FIGS. 12–20 show examples of displays that result from specific operating situations.

Figure 12:
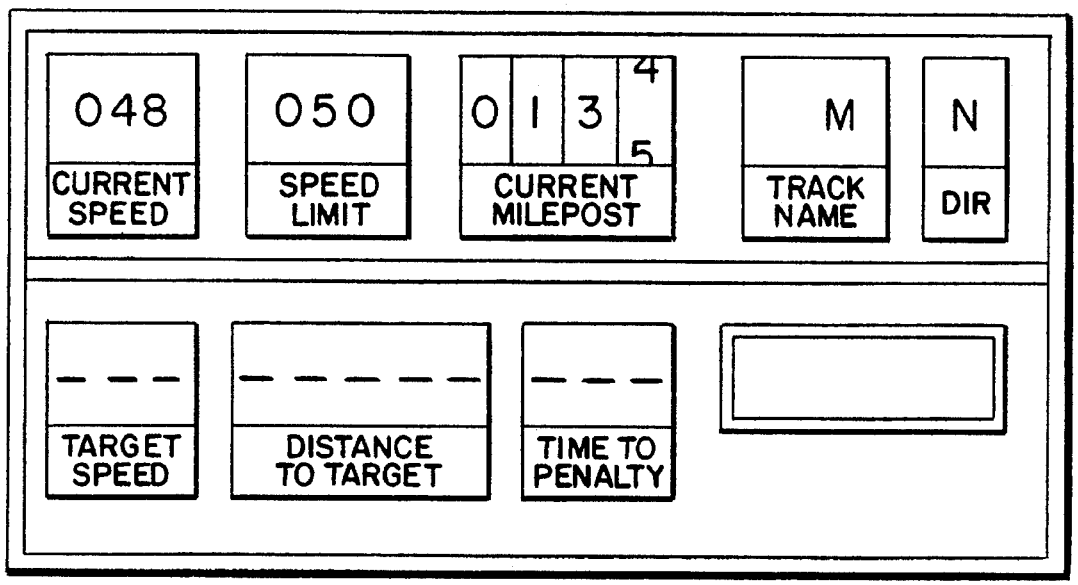
FIGS. 12–20 comprise a sequence of displayed information that would be shown on the operator display on board the train in response to examples of specific operating situations.

FIG. 12 shows the case of a train proceeding at 48 mph in an area with a 50 mph speed limit and no pending speed reductions required. Its current location is approximately mile post 13.45 on the main track, northbound.

Figure 13:
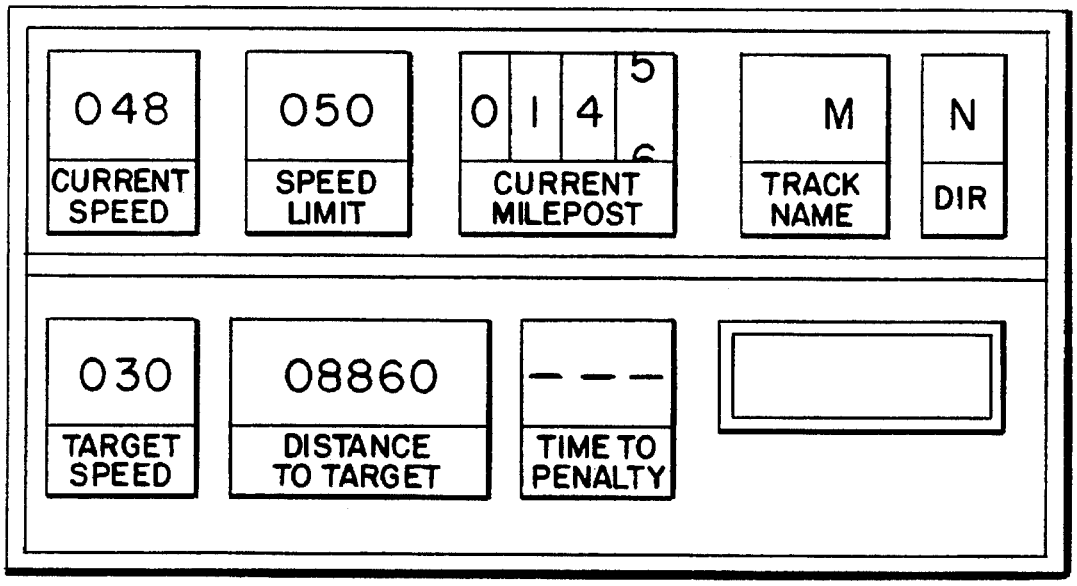

FIG. 13 shows the case where an interlocking 8860 feet ahead has a route lined to the siding over a 30 mph diverging switch. The target speed is 30 mph at a distance of 8860. Time to penalty does not show a number because the distance to target is such that enforced braking is more than 45 seconds away at the current speed.

Figure 14:
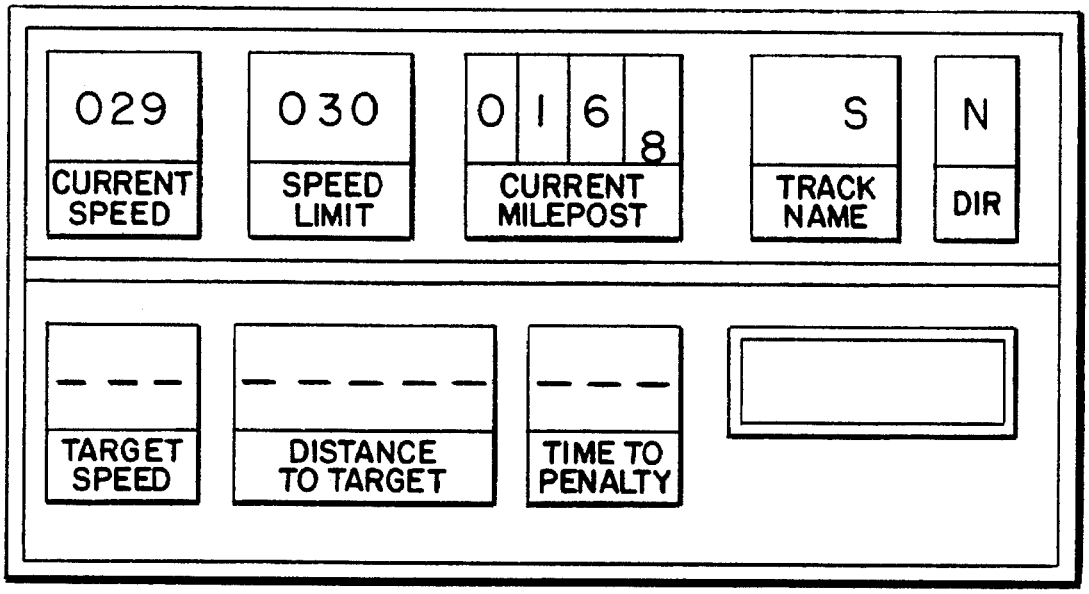

FIG. 14 shows the train entering the siding at 29 mph over the 30 mph route. At this point there is no identified target point ahead, lower than the current 30 mph limit.

Figure 15:
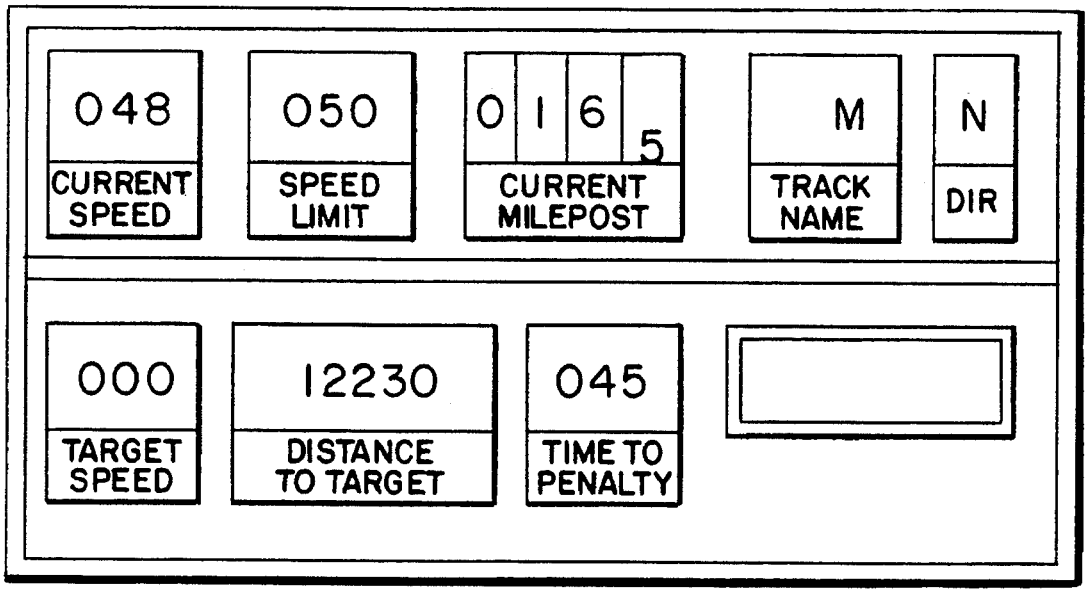

FIG. 15 starts a new series in which the train is proceeding at 48 mph in 50 mph territory, and there is a required stop (presumably a signal) at a distance of 12,230 feet. Braking calculations indicate that if the train continues at the current speed, a penalty brake will be applied in 45 seconds to assure stopping short of the target.

Figure 16:
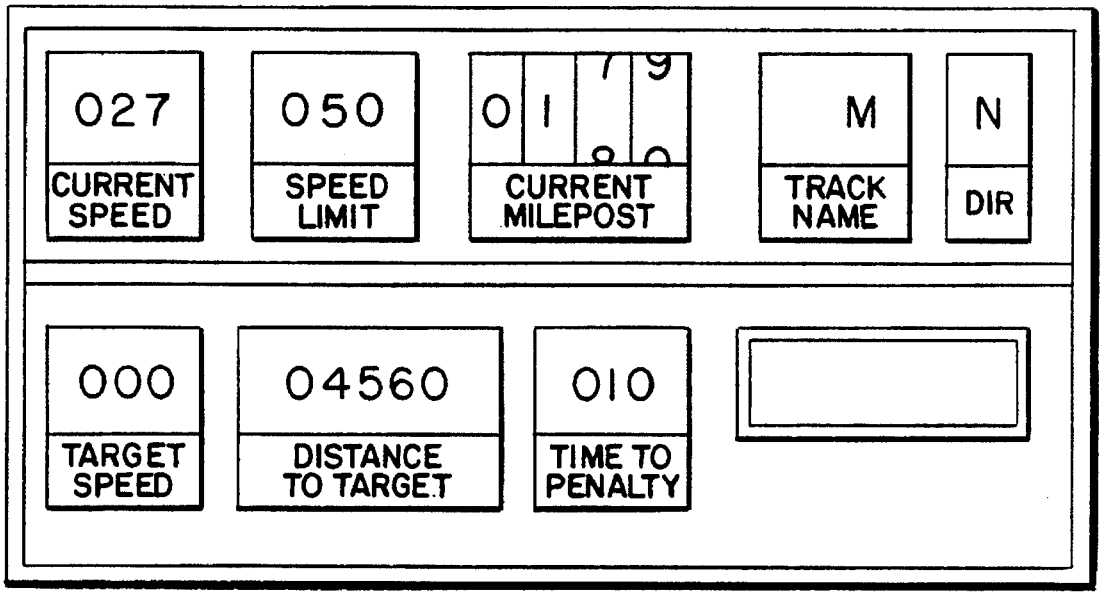

FIG. 16 shows this same train having reduced to 27 mph and reached a point 4560 feet from the target point. The engineer is following the braking profile curve and is maintaining a 10 second time to penalty.

Figure 17:
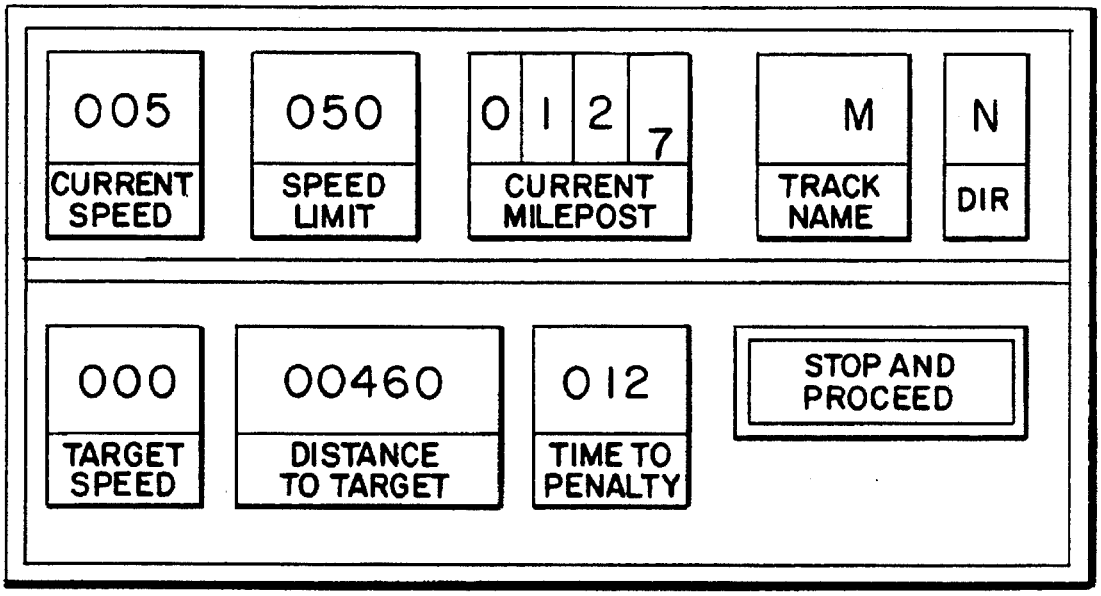

FIG. 17 shows that this train has almost stopped, moving at 5 mph and only 460 feet from the target. It displays the nature of the target as a "Stop and Proceed" signal. A full stop will be required; following that stop, the display will change to that shown in FIG. 18.

Figure 18:
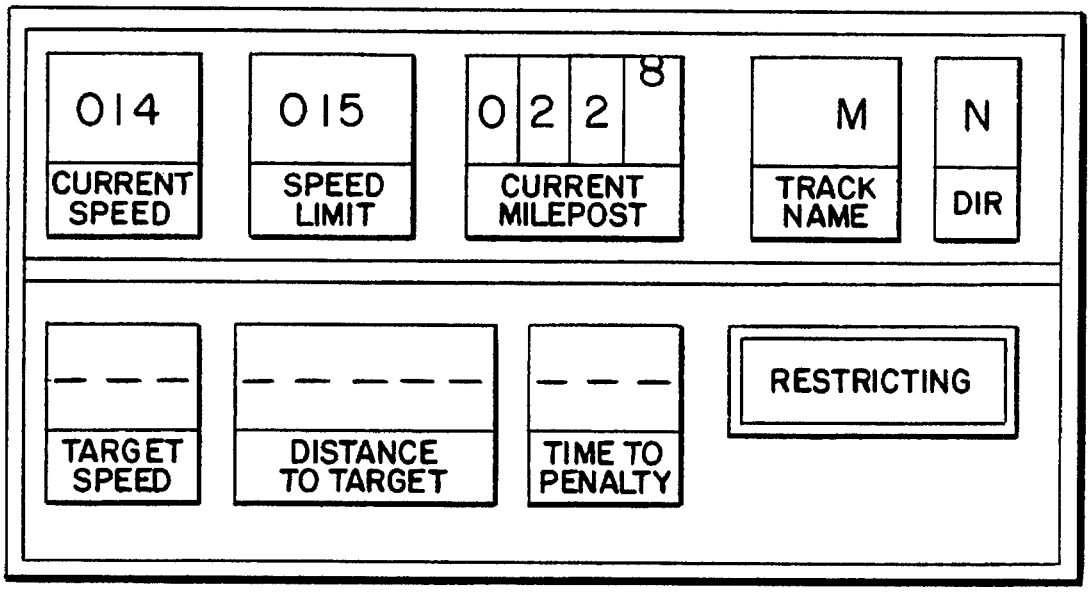

FIG. 18 shows typical operation in a restricted speed environment in which there is no target speed. The speed limit is 15 mph and the condition is "Restricting."

Figure 19:
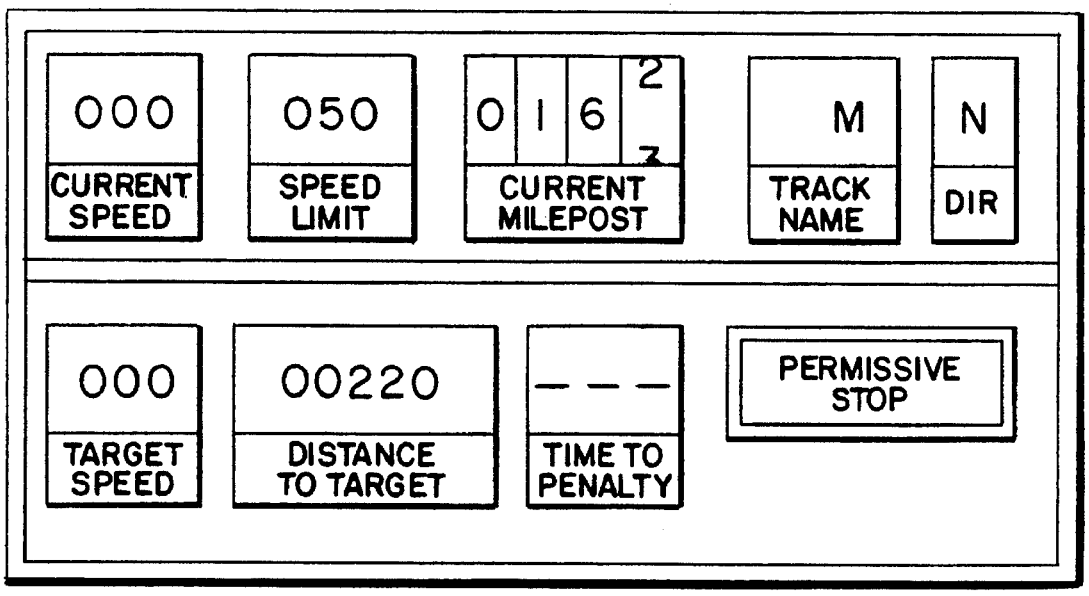

FIG. 19 shows another situation in which the train has stopped at a positive stop signal, assumed to be an interlocking, but there is no conflicting route lined which could lead to a collision if the train were to pass the signal with permission. This status is reflected in the condition displayed as "Permissive Stop." In this condition, the engineer may, depending on circumstances, choose to contact the dispatcher for permission to pass, and the system would allow him to proceed at restricted speed (FIG. 18) until a more favorable condition is detected.

Figure 20:
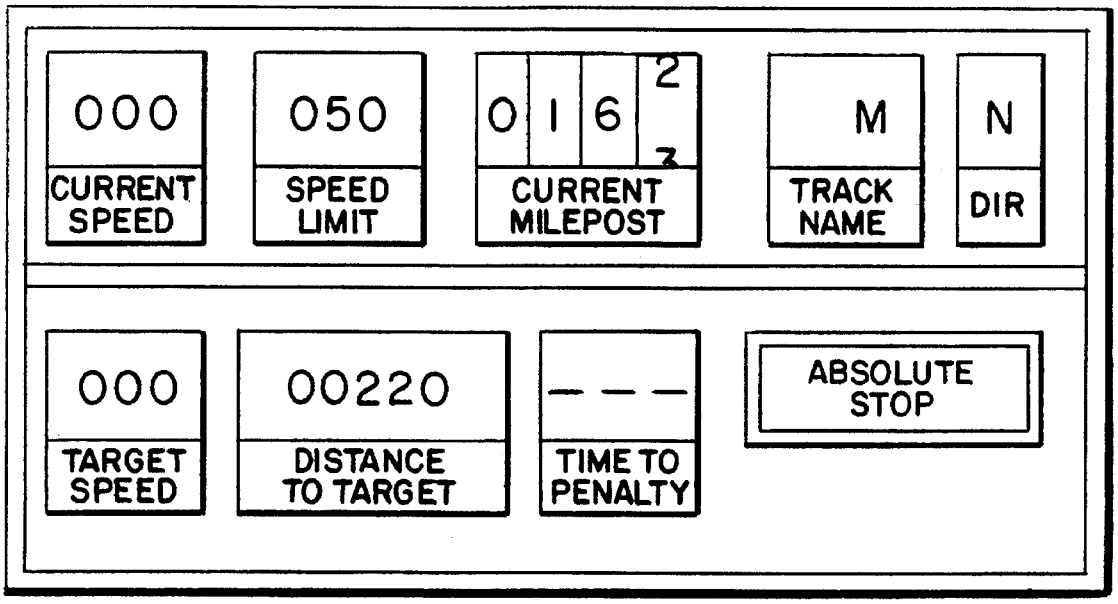

FIG. 20 shows the case in which the train has stopped at a positive stop signal, assumed to be an interlocking, and there is a conflicting route clear. Under these conditions the train should not be allowed to pass the signal and the system detects this, causing an "Absolute Stop" condition to be displayed. Any attempt to move forward in this mode will trigger an immediate penalty brake application.

Having thus described the invention, what is claimed as new and desired to be secured by Letters Patent is as follows:

1. A method of controlling the movement of a train along a railroad track comprising the steps of:

providing a plurality of wayside control units spaced along a route to be traveled by a train, each of which has responsibility for the control of a train in a corresponding local area of the route and monitors track availability and signal status information in its local area, maintaining a data base at each wayside control unit that comprises fixed data defining an operational profile of the associated local area, in a local area through which a train is passing, transmitting the fixed data for that area and dynamic data bearing said information by radio from the associated wayside unit to a receiver on board the train, and determining the proper train control instructions from the received fixed and dynamic data.

2. The method as claimed in claim 1, wherein said step of determining the proper train control instructions includes making such determination from said received fixed and dynamic data and from the location of the train along the route.

3. The method as claimed in claim 1, wherein said step of transmitting by radio the fixed and dynamic data from the associated wayside unit includes transmitting an authority message containing said dynamic data that is valid for a predetermined time period.

4. The method as claimed in claim 3, wherein said step of transmitting by radio the fixed and dynamic data from the associated wayside unit further includes interrogating the wayside unit within said period to request the transmission of an updated authority message, and applying a default rule if no updated message is received by the train.

5. The method as claimed in claim 3, wherein said step of transmitting by radio the fixed and dynamic data from the associated wayside unit further includes immediately transmitting an updated authority message containing said dynamic data in response to a change in said information.

6. The method as claimed in claim 1, wherein the operational profile of one of said local areas includes a prompt location on the route at which an authority message is to be requested by a train at said location, and wherein said method further comprises the step of requesting the transmission of said authority message containing the dynamic data regarding an approaching critical location in response to the presence of the train at said prompt location.

7. The method as claimed in claim 1, wherein said step of transmitting by radio the fixed and dynamic data from the associated wayside unit includes transmitting a profile message containing said fixed data in response to a request from a train approaching the area boundary.

8. The method as claimed in claim 1, further comprising the step of displaying said instructions to a train crew and enforcing any restrictive instructions that are not obeyed.

9. A method of controlling the movement of a train along a railroad track comprising the steps of:

providing a central control facility in which fixed data is stored that defines an operational profile of a route to be traveled by a train, providing a plurality of wayside control units spaced along said route, each of which has responsibility for the control of a train in a corresponding local area and monitors track availability and signal status information in its local area, transmitting the fixed data for each local area from the central facility to the corresponding wayside unit for storage at the unit, in a local area through which a train is passing, transmitting the fixed data for that area and dynamic data bearing said information by radio from the associated wayside unit to a receiver on board the train, and determining the proper train control instructions from the received fixed and dynamic data.

10. The method as claimed in claim 9, wherein said step of transmitting fixed data to the wayside units includes modifying the fixed data transmitted to the respective wayside units in response to changes in the operational profile of the route.

11. The method as claimed in claim 9, wherein said step of determining the proper train control instructions includes making such determination from said received fixed and dynamic data and from the location of the train along the route.

12. The method as claimed in claim 9, wherein said step of transmitting by radio the fixed and dynamic data from the associated wayside unit includes transmitting an authority message containing said dynamic data that is valid for a predetermined time period.

13. The method as claimed in claim 12, wherein said step of transmitting by radio the fixed and dynamic data from the associated wayside unit further includes interrogating the wayside unit within said period to request the transmission of an updated authority message, and applying a default rule if no updated message is received by the train.

14. The method as claimed in claim 12, wherein said step of transmitting by radio the fixed and dynamic data from the associated wayside unit further includes immediately transmitting an updated authority message containing said dynamic data in response to a change in said information.

15. The method as claimed in claim 9, wherein the operational profile of one of said local areas includes a prompt location on the route at which an authority message is to be requested by a train at said location, and wherein said method further comprises the step of requesting the transmission of said authority message containing the dynamic data regarding an approaching critical location in response to the presence of the train at said prompt location.

16. The method as claimed in claim 9, wherein said step of transmitting by radio the fixed and dynamic data from the associated wayside unit includes transmitting a profile message containing said fixed data in response to a request from a train approaching the area boundary.

17. The method as claimed in claim 9, further comprising the step of displaying said instructions to a train crew and enforcing any restrictive instructions that are not obeyed.

18. In a system for controlling the movement of a train along a railroad track, the combination comprising:

a series of wayside control units adapted to be spaced along a route to be traveled by a train on said track, each of which has responsibility for the control of a train in a corresponding local area of the route and monitors track availability and signal status information in its local area, each of said wayside control units having means for storing a data base that comprises fixed data defining an operational profile of the associated local area, and means for transmitting the fixed data for that area and dynamic data bearing said information by radio to a train within the area, control means adapted to be carried on board a train for receiving transmissions of fixed and dynamic data from the wayside unit or units responsible for control of the train, and said control means having computer means for determining the proper train control instructions from the received fixed and dynamic data.

19. The combination as claimed in claim 18, wherein said control means on board a train has means for determining the location of the train along the route.

20. The combination as claimed in claim 18, wherein each of said wayside units has a data radio for transmitting a profile message containing said fixed data and an authority message containing said dynamic data, said control means having a data radio for transmitting requests to the controlling wayside unit or units for transmission of said profile and authority messages.

21. The combination as claimed in claim 18, further comprising a central control facility in which fixed data is stored that defines the operational profile of the entire route, and a plurality of dispatcher data lines from said central facility to the respective wayside units for updating the stored profiles of the corresponding local areas in response to changes in the operational profile of the route.

22. The combination as claimed in claim 18, wherein said control means includes means for displaying said instructions to a train crew and enforcing any restrictive instructions that are not obeyed.

23. The combination as claimed in claim 18, wherein said control means has means for calculating train length by comparing locomotive location on the track with a critical location on the profile that the train has cleared.

* * * * *